US008254798B2

(12) United States Patent
Sugimoto

(10) Patent No.: US 8,254,798 B2
(45) Date of Patent: Aug. 28, 2012

(54) IMAGE FORMING APPARATUS, TONER CARTRIDGE, AND COMPUTER-READABLE MEDIUM

(75) Inventor: Tasuku Sugimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 335 days.

(21) Appl. No.: 12/623,035

(22) Filed: Nov. 20, 2009

(65) Prior Publication Data

US 2010/0129099 A1 May 27, 2010

(30) Foreign Application Priority Data

Nov. 25, 2008 (JP) ..... 2008-299978
Sep. 15, 2009 (JP) ..... 2009-212836

(51) Int. Cl.
*G03G 15/00* (2006.01)
*G03G 15/08* (2006.01)

(52) U.S. Cl. ..... 399/46; 399/53

(58) Field of Classification Search ..... 399/27, 399/46, 53
See application file for complete search history.

(56) References Cited

U.S. PATENT DOCUMENTS 6,343,193 B1 * 1/2002 Matsumoto et al. ..... 399/27
7,597,429 B2 * 10/2009 Miura et al. ..... 347/71
2008/0056742 A1 * 3/2008 Hattori et al. ..... 399/44

FOREIGN PATENT DOCUMENTS

JP 2001-194966 7/2001
JP 2005157176 A * 6/2005
JP 2007-052149 3/2007
JP 2008-070605 3/2008

OTHER PUBLICATIONS

Notification of Reasons for Refusal dispatched Nov. 2, 2010 in Japanese Application No. 2009-212836 and English translation thereof.

* cited by examiner

*Primary Examiner* — David Gray
*Assistant Examiner* — Gregory H Curran
(74) *Attorney, Agent, or Firm* — Banner & Witcoff, Ltd.

(57) ABSTRACT

An image forming apparatus includes: a cartridge attachment portion; an image forming unit; a reading unit; and a control unit. A toner cartridge configured to accommodate toner is removably attached to the cartridge attachment portion. The toner cartridge includes a cartridge mechanism unit mechanically driven and a storage medium for storing torque information including information indicating torque used for a mechanical drive of the cartridge mechanism unit. The image forming unit is configured to print an image on a surface of a printing medium using toner accommodated in the toner cartridge. The reading unit is configured to read the torque information from the toner cartridge attached to the cartridge attachment portion. The control unit is configured to determine a number of printing media to be printed by the image forming unit per unit time, according to the torque information read by the reading unit.

17 Claims, 6 Drawing Sheets

| REMAINING TONER AMOUNT (%) | 100~81 | 80~61 | 60~41 | 40~21 | 21~1 |
|---|---|---|---|---|---|
| NUMBER OF ALLOWABLE CONTINUOUS PRINTS | 30 | 50 | 80 | 100 | ∞ |

175Kt

| REMAINING TONER AMOUNT (%) | 100~81 | 80~61 | 60~41 | 40~21 | 21~1 |
|---|---|---|---|---|---|
| NUMBER OF ALLOWABLE CONTINUOUS PRINTS | 30 | 50 | 80 | 100 | ∞ |

IMAGE FORMING APPARATUS, TONER CARTRIDGE, AND COMPUTER-READABLE MEDIUM

CROSS-REFERENCE TO RELATED APPLICATIONS

This application claims priority from Japanese Patent Application No. 2008-299978 filed on Nov. 25, 2008 and Japanese Patent Application No. 2009-212836 filed on Sep. 15, 2009, the entire contents of which are incorporated herein by reference.

TECHNICAL FIELD

The present invention relates to a control of an image forming apparatus.

BACKGROUND

In a formation of an electro-photographic image, rotating bodies such as a photoconductor drum and a developing drum are driven. When a toner cartridge including the photoconductor drum is used, driving torque required for driving the toner cartridge is different depending on the specification of the toner cartridge. Therefore, a known technique is proposed in which information on the driving torque is stored in the toner cartridge and can be utilized for a printer.

The above-described technique realizes a driving control according to the driving torque required for driving a toner cartridge. However, the technique provides the driving control by merely outputting motor current values stored in association with the driving torque, without any consideration for a change in internal environments of an image forming apparatus due to the drive.

SUMMARY

The present invention was made in consideration for at least a part of the above-described circumstances, an object thereof is to provide technique for forming an image in an image forming apparatus while the change of internal environment of the image forming apparatus falls within an allowable range.

According to a first aspect of the invention, there is provided an image forming apparatus comprising: a cartridge attachment portion to which a toner cartridge configured to accommodate toner is removably attached, the toner cartridge comprising a cartridge mechanism unit which is mechanically driven and a storage medium for storing torque information including information indicating torque used for a mechanical drive of the cartridge mechanism unit; an image forming unit configured to print an image on a surface of a printing medium using toner accommodated in the toner cartridge; a reading unit configured to read the torque information from the toner cartridge attached to the cartridge attachment portion; and a control unit configured to determine a number of printing media to be printed by the image forming unit per unit time, according to the torque information read by the reading unit.

According to a second aspect of the invention, there is provided a toner cartridge configured to supply toner to an image forming apparatus, said image forming apparatus comprises a cartridge attachment portion to which said toner cartridge is removably attached; an image forming unit configured to print an image on a surface of a printing medium using the toner; a reading unit configured to read torque information from said toner cartridge attached to said cartridge attachment portion; and a control unit configured to determine a number of printing media to be printed by said image forming unit per unit time according to the torque information read by said reading unit, said toner cartridge comprising: a cartridge mechanism unit mechanically driven when said toner cartridge is attached to said cartridge attachment portion; a storage medium configured to store the torque information including information indicating torque used in a mechanical drive of the cartridge mechanism unit; and an interface circuit configured to output the torque information to said reading unit of said image forming apparatus.

According to a third aspect of the invention, there is provided a computer-readable medium having a computer program stored thereon and readable by a computer, said computer program for enabling a mechanical drive control of an image forming apparatus, said image forming apparatus comprising: a cartridge attachment portion to which a toner cartridge configured to accommodate toner is removably attached, the toner cartridge comprising a cartridge mechanism unit which is mechanically driven and a storage medium for storing torque information including information indicating torque used for a mechanical drive of the cartridge mechanism unit; an image forming unit configured to print an image on a surface of a printing medium using toner accommodated in the toner cartridge; a reading unit configured to read the torque information from the toner cartridge attached to the cartridge attachment portion; and a control unit, said computer program, when executed by the image forming apparatus, to cause the control unit of the image forming apparatus to perform operations comprising: reading the torque information from the toner cartridge attached to the cartridge attachment portion; and determining a number of printing media to be printed by the image forming unit per unit time, according to the torque information read from the toner cartridge.

According to a fourth aspect of the invention, there is provided an image forming apparatus comprising: a printing device configured to print an image on a sheet using toner; a toner cartridge configured to supply toner to the printing device, the toner cartridge comprising: a storage medium configured to store a table comprising one or more sets of associated information, each of the sets of associated information comprising a remaining toner amount and an allowable number of sheets to be continuously printed by the printing device; and a toner accommodation portion configured to accommodate the toner, a reading device configured to read the association information from the storage medium; a toner sensor configured to detect an amount of toner remaining in the toner accommodation portion; and a control unit connected to the toner sensor and the printing device, wherein the control unit is operable to: control the toner sensor so as to detect the amount of toner; control the reading device so as to read the allowable number of sheets associated with the remaining toner amount corresponding to the amount of toner detected by the toner sensor, from the table stored in the storage medium; and change a number of sheets to be printed by the printing device per unit time if a number of sheets which the printing device has been printed reaches the allowable number of sheets read by the reading device.

According to a fifth aspect of the invention, there is provided a toner cartridge configured to supply toner to an image forming apparatus, said toner cartridge comprising: a storage medium configured to store a table comprising one or more sets of associated information, each of the sets of associated information comprising a remaining toner amount and an allowable number of sheets to be continuously printed by the printing device; and a toner accommodation portion configured to accommodate the toner.

DESCRIPTION

Figure 1:
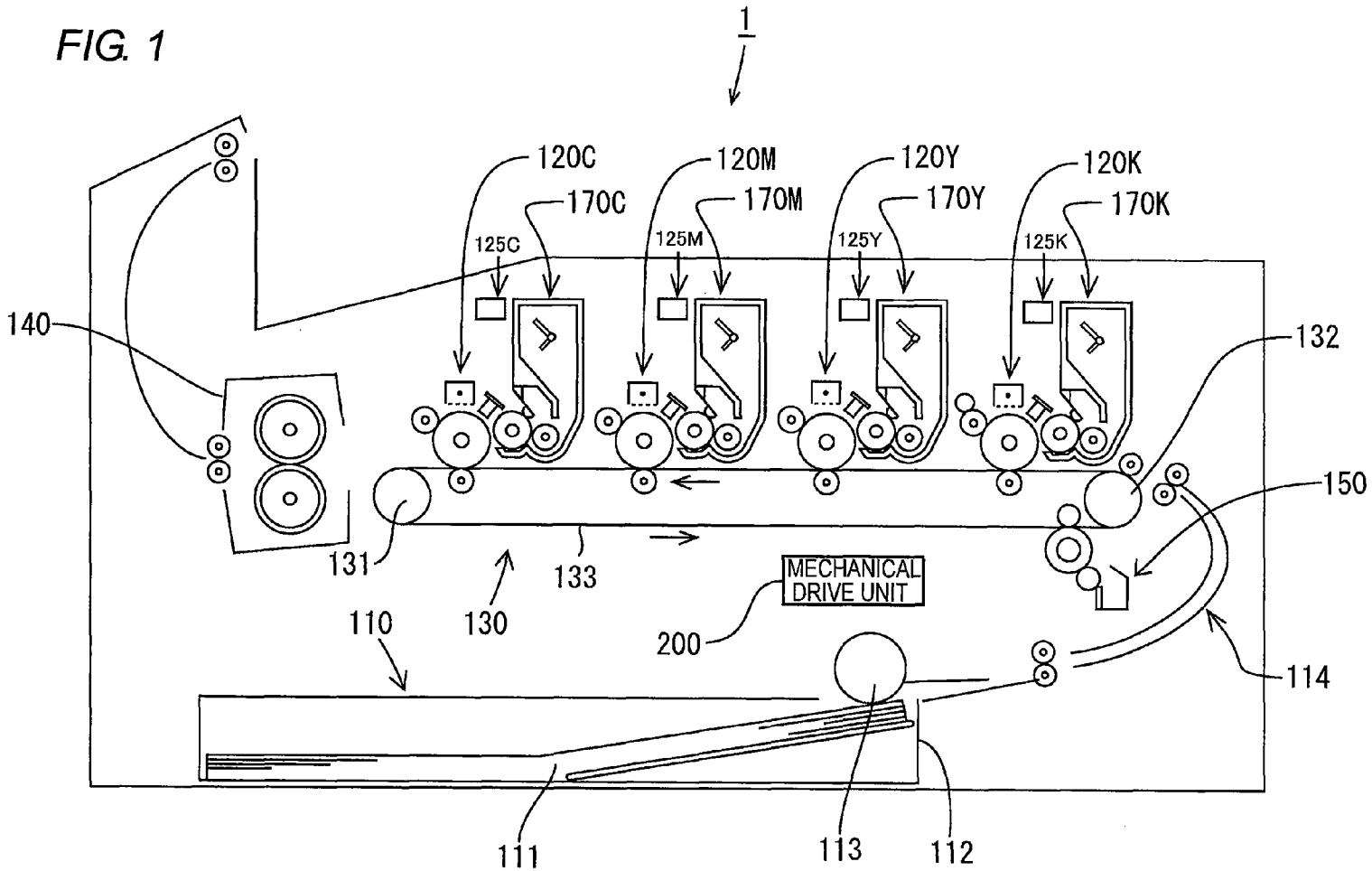
FIG. 1 is a schematic cross-sectional view showing an internal configuration of a printer according to embodiments of the present invention.

Next, illustrative aspects of the present invention will be described with reference to exemplified embodiments in the following order.

A. Brief configuration of an image forming apparatus of embodiments of the present invention;

B. Mechanical drive control of an image forming apparatus according to Embodiment 1 of the present invention;

C. Print processing according to Embodiment 1 of the present invention;

C-1. Modification 1 of Embodiment 1;

C-2. Modification 2 of Embodiment 1;

D. Print processing according to Embodiment 2 of the present invention; and

E. Modified Embodiments

A. Brief Configuration of an Image Forming Apparatus of Embodiments of the Present Invention In the present embodiment, a printer 1 (an example of an image forming apparatus) is an electro-photographic printer configured to form an image with toners of C (cyan), M (magenta), Y (yellow) and K (black).

The printer 1 includes: a feeding unit 110, image forming units 120C, 120M, 120Y and 120K for respective colors; a conveying mechanism 130; a fixing unit 140; a belt cleaning mechanism 150; and a mechanical drive unit 200. Toner cartridges 170C, 170M, 170Y, 170K for supplying respective color toners are attached to the image forming units 120K, 120Y, 120M, 120C, respectively. The mechanical drive unit 200 of the present embodiments supplies power to the image forming units 120C, 120M, 120Y, 120K and mechanical units of the toner cartridges 170C, 170M, 170Y, 170K attached thereto, respectively.

The feeding unit 110 includes: a tray 112 configured to store sheet members 111 (an example of printing medium) such as printing sheets and OHP sheets; a pickup roller 113 configured to pick up the sheet member 111 one by one; and a feeding mechanism 114 configured to feed the sheet member 111 to the conveying mechanism 130.

The conveying mechanism 130 is configured to convey the sheet member 111 sequentially to the image forming units 120K, 120Y, 120M, 120C. The conveying mechanism 130 includes: a driving roller 131; a driven roller 132; and a belt 133 extending between and around the driving roller 131 and the driven roller 132.

Figure 2:
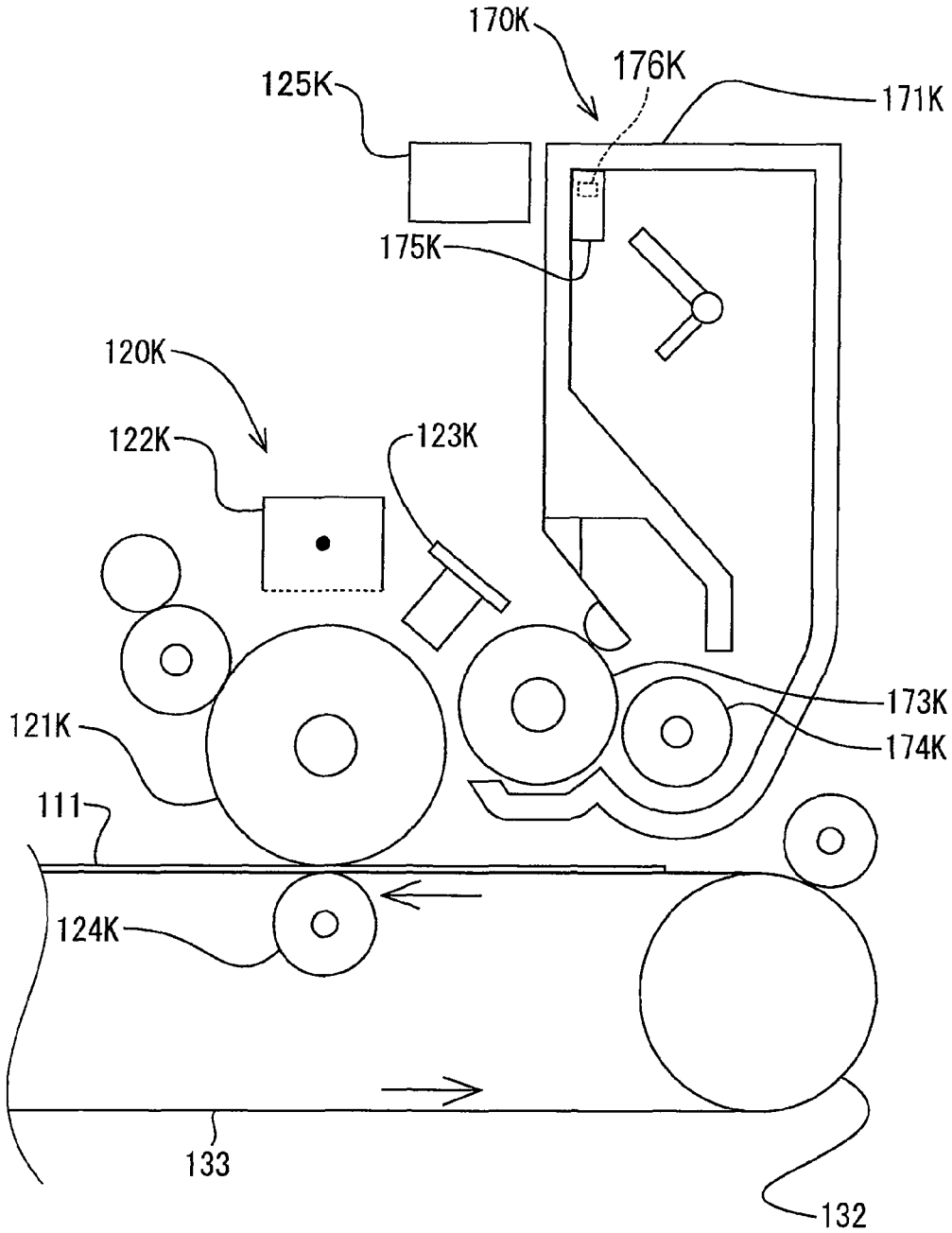
FIG. 2 is an enlarged view showing the image forming unit 120K in the embodiments of the present invention.

The image forming unit 120K has a configuration substantially similar to that of the image forming units 120C, 120M, 120Y. For a simplified description, the image forming unit 120K will be described as an example of the image forming units 120K, 120C, 120M, 120Y, with reference to FIG. 2.

The image forming unit 120K includes: a photoconductor body 121K; a charger 122K configured to charge a surface of the photoconductor body 121K; an exposure device 123K configured to expose the surface of the photoconductor body 121K so as to form an electrostatic latent image; and a transfer roller 124K configured to transfer a toner image provided on the surface of the photoconductor body 121K to the sheet member 111. To the image forming unit 120K, the toner cartridge 170K including a nonvolatile memory 175K (an example of a storage medium) is attached. The image forming unit 120K further includes a reader 125K (an example of a reading unit or device) configured to read information from the nonvolatile memory 175K. The reader 125K is disposed at a position opposing the nonvolatile memory 175K.

The toner cartridge 170K includes: a development roller 173K configured to perform development process by supplying toner to the electrostatic latent image formed on the surface of the photoconductor body 121K; a supply roller 174K configured to supply toner to the development roller 173K; an agitator 172K configured to agitate the toner; a toner case 171K (an example of a toner accommodation portion) configured to accommodate the toner; and the nonvolatile memory 175K. The development roller 173K, the supply roller 174K and the agitator 172K are an example of cartridge mechanism units. The nonvolatile memory 175K is provided with an interface circuit 176K configured to output torque information in response to a request from the reader 125K. The reader 125K and the interface circuit 176 may be connected via an electrical connection between terminal provided at the printer 1 and a terminal provided at the toner cartridge 170K. Instead, the reader 125K and the interface circuit 176K may be wirelessly connected. For example, the nonvolatile memory 175K may be formed by a contactless integrated circuit, and the reader 125K may wirelessly read the information from the nonvolatile memory 175K.

The process for forming a toner image on the surface of the photoconductor body 121K is as follows: At first, the charger 122K charges the surface of the photoconductor body 121K. Next, the exposure device 123K irradiates light, which is modulated based on an image to be formed, to the surface of the photoconductor body 121K. Accordingly, the potential distribution corresponding to the image to be formed, i.e., the electrostatic latent image is formed on the surface of the photoconductor body 121K.

Next, the development roller 173K provides the toner on the electrostatic latent image. As a result, the toner image is formed on the surface of the photoconductor body 121K. The toner image formed on the surface of the photoconductor body 121K is transferred to the surface of the sheet member 111 by the transfer roller 124K.

After a transfer process of the toner image of K (black) is completed, the transfer process of the toner images of Y (yellow), M (magenta) and C (cyan) on sheet members 111 is similarly performed. When the transfer process is completed for all the toner images of K (black), Y (yellow), M (magenta) and C (cyan), the toner image containing all colors of K (black), Y (yellow), M (magenta) and C (cyan) is formed on the sheet member 111. Since the toner image is merely attached on the sheet member 111 by an electrostatic force, the toner image may be removed due to external actions such as a friction force. Consequently, the sheet member 111 is conveyed to a fixing unit 140 (see FIG. 1) so as to fix the toner image on the sheet member 111.

The fixing unit 140 heats the toner image and applies pressure on a sheet member 111. According to this process, the toner image is fixed on the sheet member 111 and is hardly removed from the sheet member 111. On completion of the fixing by the heat and pressure, the sheet member 111 is discharged on an upper surface of the printer 1, and the printing process is completed.

Figure 3:
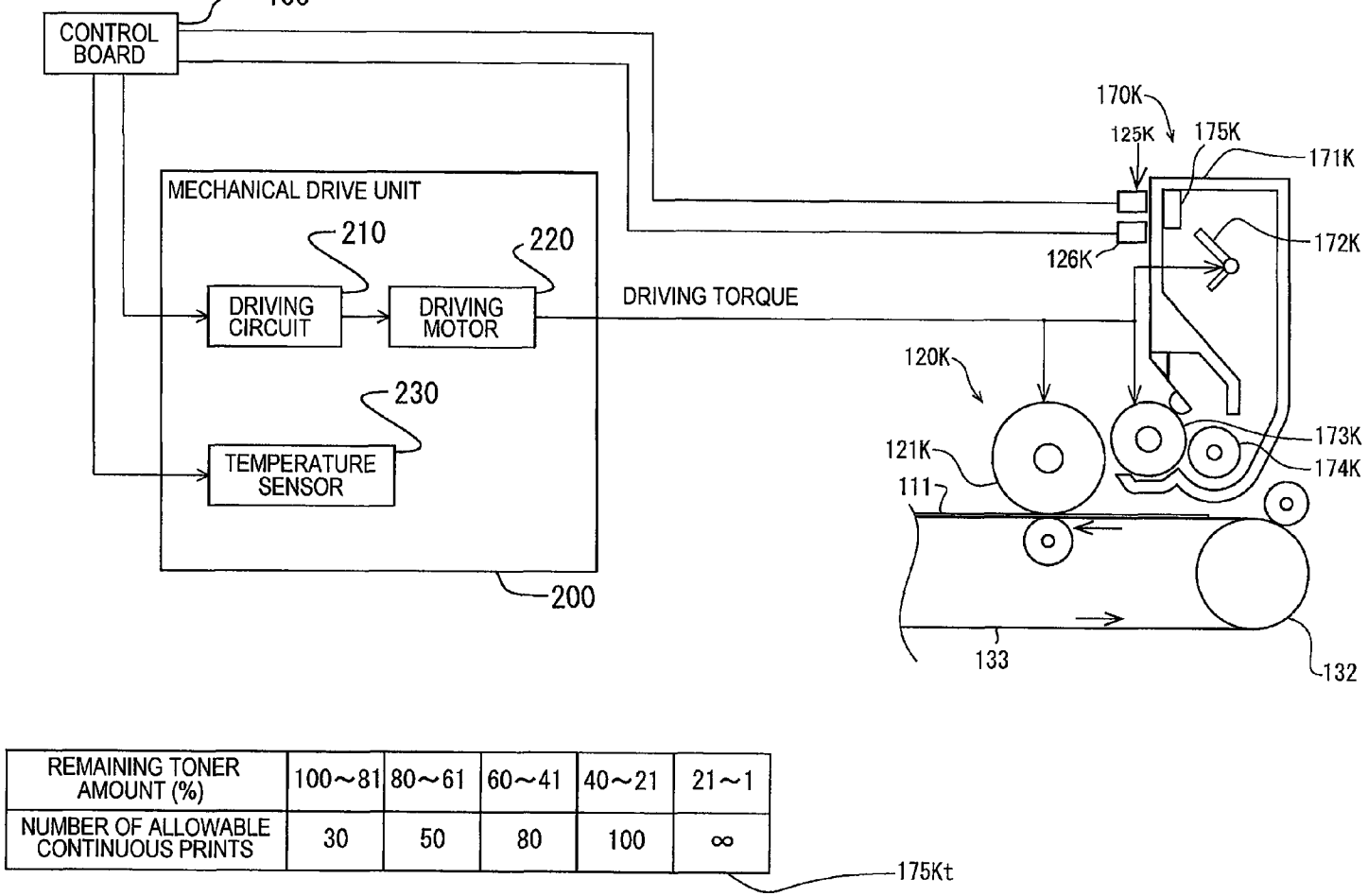
FIG. 3 is an explanatory diagram showing a mechanical drive system of the printer according to Embodiment 1 of the present invention.

B. Mechanical Drive Control of the Image Forming Apparatus According to Embodiment 1 of the Present Invention As shown in FIG. 3, a mechanical drive unit 200 is controlled in response to an instruction signal from a control board 100 (an example of a control unit, an estimation unit and a determination unit) configured to control an entire of the printer 1.

The mechanical drive unit 200 includes: a driving circuit 210; a driving motor 220; and a temperature sensor 230 (an example of a measurement unit). The driving circuit 210 controls the driving motor 220 so as to be driven at a predetermined speed in response to the instruction signal from the control board 100. The driving motor 220 supplies power to the photoconductor body 121K of the image forming unit 120K and a mechanical unit of the toner cartridge 170K. On the other hand, the driving roller 131 (FIG. 1), the pickup roller 113 (FIG. 1) and the fixing unit 140 are mechanically driven by other mechanical drive units (not shown). It is noted that the configurations for other colors of cyan, magenta and yellow are similar to that of black, and a description thereof is omitted.

The mechanical unit of the toner cartridge 170K includes: the development roller 173K configured to perform a development process to the photoconductor body 121K; the supply roller 174K configured to supply the toner to the development roller 173K; and the agitator 172K configured to agitate the toner. Incidentally, the mechanical unit of the toner cartridge 170K is designed so as to adapt to physical properties, such as physical properties of a newly developed toner. Therefore, the torque required for driving the mechanical unit of the toner cartridge 170 is assumed to be different for each cartridge.

However, depending on the physical properties of the toner, the torque required for driving a toner cartridge may be larger than a load torque appropriate for an image forming apparatus to perform a continuous printing operation using the toner cartridge. The present inventor has found that, even when the load torque is excessively large for the image forming apparatus, the image forming apparatus can be workable if the drive is restricted to limited time periods.

Figure 4A:
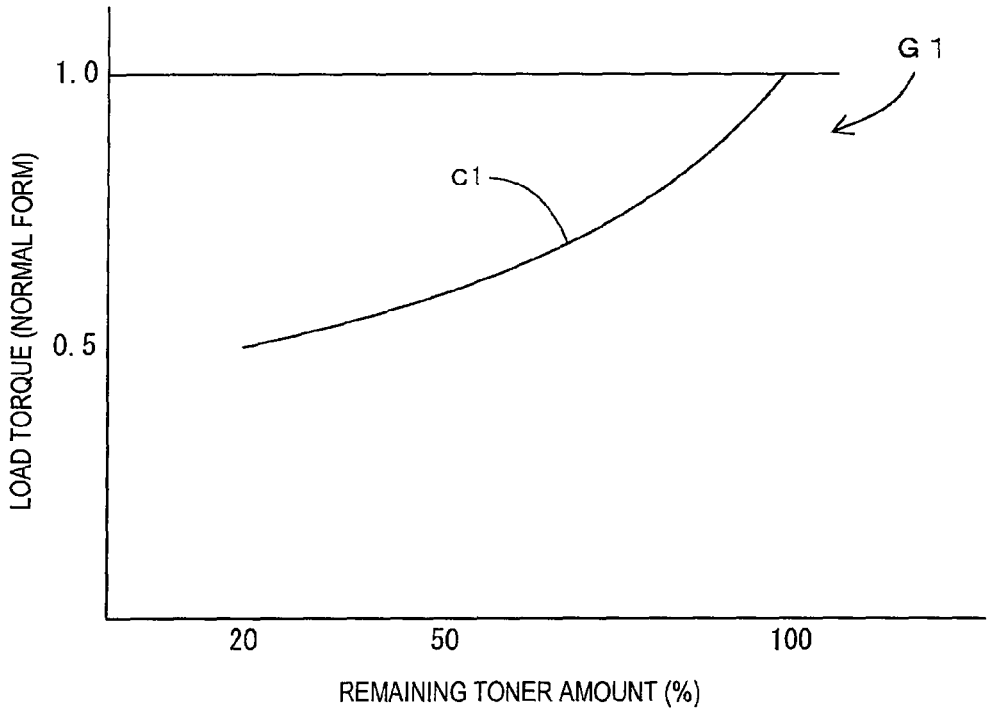
FIGS. 4A and 4B are graphs showing mutual relationships between a remaining toner amount, load torque and temperature rise of the mechanical drive unit according to Embodiment 1 of the present invention.
Figure 4B:
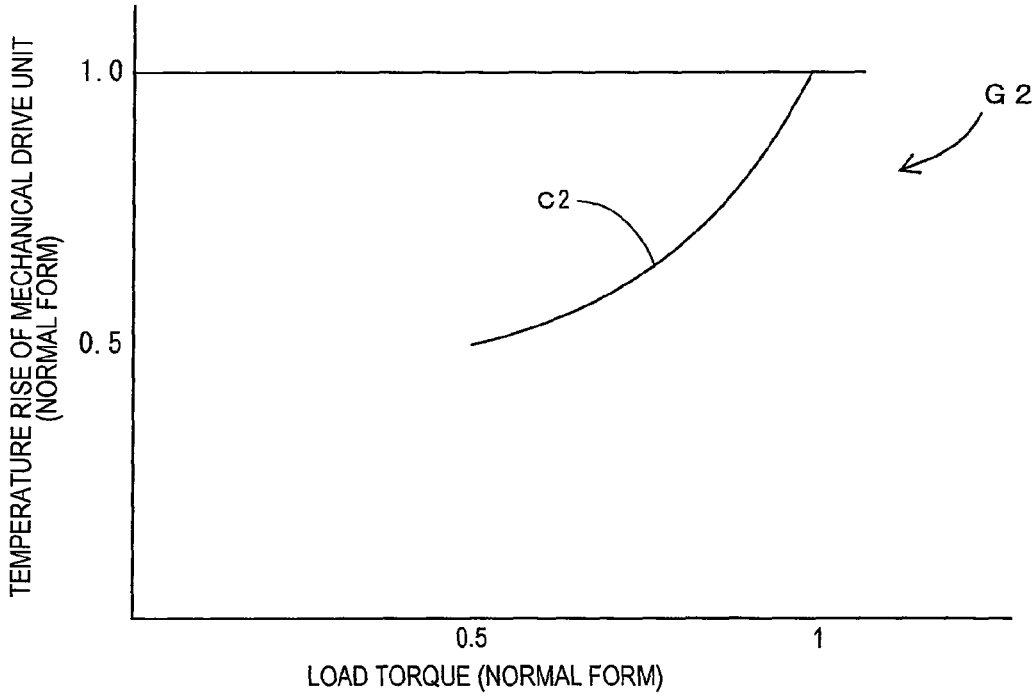

As shown in FIG. 4A, a graph G1 shows a relationship between a remaining toner amount and load torque. As used herein, the term "load torque" corresponds to a force acting on a shaft of the driving motor 220. As is clear from FIG. 4A, the greater the remaining toner amount is, the greater the load torque becomes. This is because driving load for agitating the toner by the agitator 172K (FIG. 2) is a large part of the load torque, and the load for agitating the toner increases as the remaining toner amount is greater. As shown in FIG. 4B, a graph G2 shows a relationship between the load torque and a temperature rise of the mechanical drive unit 200. As used herein, a temperature in the "temperature rise of the mechanical driving unit 200" corresponds to a stabilized (saturated) surface temperature of the driving circuit 210 when the printer 1 placed at 25° C. performs the continuous printing operation. According to the graph G2, it is clear that the greater the load torque is, the greater the temperature rise increases. It is noted that in the graphs G1 and G2, the load torque and the temperature rise are both expressed by normalization in which a maximum value is given as "1."

A table 175Kt illustrated in FIG. 3 shows data which are set based on the above characteristics. In the present embodiment, the nonvolatile memory 175K of the toner cartridge 170K stores the data together with the load torque for the toner cartridge 170K. The data indicates a relationship between a number of allowable continuous prints and a remaining toner amount. As used herein, the term "a number of allowable continuous prints" corresponds to the number of sheet members 111 which can be printed continuously by the printer 1. More specifically, for example, when the remaining toner amount is 70% as compared with an amount at the time of attachment, 50 sheets can be printed continuously.

The data may be stored, for example, for each type of printer to which the toner cartridge 170K is to be attached. Further, the data may be stored, for example, in a form such that: 30 sheets for the remaining toner amount 100%; and 50 sheets for the remaining toner amount 80%.

As used herein, the term "remaining toner amount" is a value determined according to an amount of used toner (for example, an amount of remaining toner can also be defined as a value obtained by deducting an amount of used toner from an amount of toner at the time of opening a cartridge) and may have a wide meaning including an amount (quantity) correlated with the amount of used toner. Further, the remaining toner amount can be determined by various methods, for example, by estimation based on: the load of agitating toner in the toner case 171K; an amount of light transmitting in the toner case 171K at the time of agitation; and reduction in the amount of toner used in forming images. In other words, the control board 100 may be operable as a toner sensor configured to detect the remaining toner amount based on various information, such as the load of agitating toner, and the number of prints, etc. Further, a sensor 126K such as photosensor configured to detect the remaining toner amount may be provided. The sensor 126K is connected to the control board 100, and the control board 100 controls the sensor 126K and obtains the remaining toner amount based on the output from the sensor 126K.

C. Print processing in Embodiment 1 of the Present Invention

Figure 5:
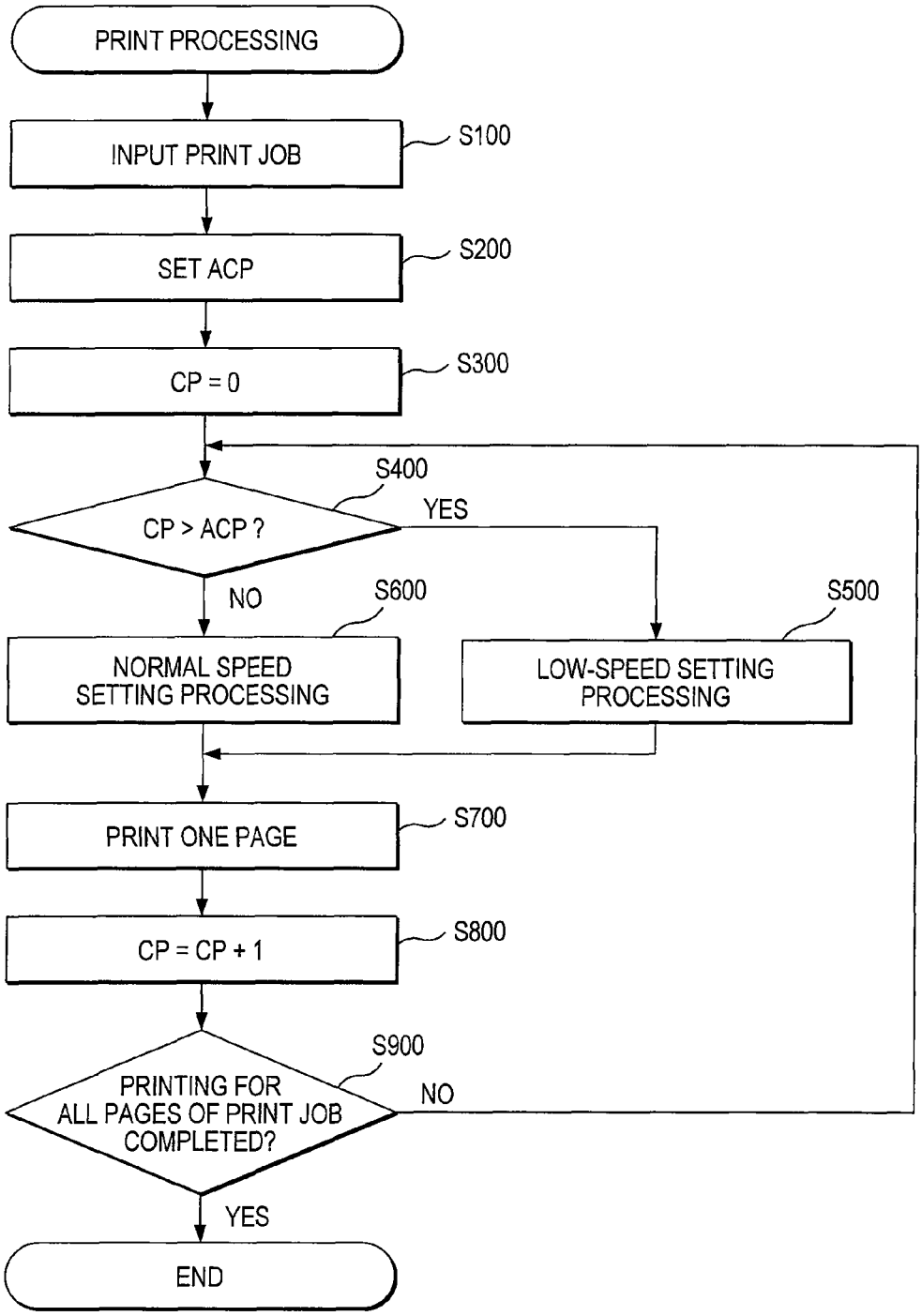
FIG. 5 is a flowchart showing routines of print processing in Embodiment 1 of the present invention.

The print processing shown in FIG. 5 is performed when a print job is requested to a printer 1. The print job may be requested, for example, in response to print data transmitted from a PC (not shown) connected to the image forming apparatus or in response to instructions through operation buttons (not shown) provided at the printer 1. In Step S100, the printer 1 inputs a single print job. In the present embodiment, for easy description, assumed is a case where a single print job is input.

In Step S200, the printer 1 sets the number of allowable continuous prints ACP. The number of allowable continuous prints ACP is set based on the number of allowable continuous prints and the remaining toner amount read from each of four toner cartridges 170C, 170M, 170Y, 170K. More specifically, the printer 1 calculates a weighted mean value of the remaining toner amounts and refers to the stored data 175KT (see FIG. 3) of the memory 175K according to the weighted mean value, thereby determining the number of allowable continuous prints ACP.

The weighted mean value is a method for determining the remaining toner obtained, for example, by weighting a toner remaining amount in the toner cartridge 170K twice as that in each of other toner cartridge 170C, 170M and 170Y if the black toner cartridge 170K has a size larger than that of each of other color cartridges 170C, 170M and 170Y and also has load torque twice as that of each of other color cartridges 170C, 170M and 170Y. More specifically, the weighted mean value is obtained by: multiplying the toner remaining amount in each of the three toner cartridges 170C, 170M, 170Y with a weighted value of 0.2; calculating a sum of the multiplied values of the three toner cartridges 170C, 170M, 170Y; multiplying the toner remaining amount in the toner cartridge 170K with a weighted value of 0.4; and calculating a total sum. Accordingly, the number of allowable continuous prints ACP can be determined.

For example, when the toner remaining amount of the toner cartridge 170C TC=90%, the toner remaining amount of the toner cartridge 170M TM=90%, the toner remaining amount of the toner cartridge 170Y TY=70%, and the toner remaining amount of the toner cartridge 170K TK=50%, the weighted mean value of the toner remaining amount TA is obtained by the following formula:

$$TA=0.2TC+0.2TM+0.2TY+0.4TK=70\%$$

and with reference to the stored data 175KT of the nonvolatile memory 175K (see FIG. 3), the number of allowable continuous prints ACP can be determined as: ACP=50 sheets.

The number of allowable continuous prints ACP may be determined by a calculation based on the toner remaining amount detected every time a print job is started, or may be determined by a calculation based on the toner remaining amount detected every time the printer 1 is powered on. The former is advantageous in that the number of allowable continuous prints ACP can be appropriately updated based on the latest toner remaining amount, and the latter is advantageous in that a number of accesses to the memory of the toner cartridges 170C, 170M, 170Y, 170K can be lowered.

The number of allowable continuous prints ACP may be determined only based on the load torque at the time of attachment of each of the toner cartridges 170C, 170M, 170Y, 170K (i.e., the toner remaining amount=100%). Accordingly, the method for obtaining the number of allowable continuous prints ACP according to the embodiment is easily applicable.

In Step S300, the printer 1 initializes a value of the number of continuous prints CP to 0 (zero). Accordingly, it is possible to count the number of sheets which is continuously printed according to the (single) input print job.

In Step S400, the printer 1 determines whether the number of continuous prints CP is in excess of the number of allowable continuous prints ACP. If the number of continuous prints CP is not greater than the number of allowable continuous prints ACP (Step S400: No), the processing proceeds to Step S600. On the other hand, if the number of continuous prints CP is greater than the number of allowable continuous prints ACP (Step S400: Yes), the processing proceeds to Step S500.

In Step S500, the printer 1 conducts low-speed setting processing. The low-speed setting processing is processing for setting at least one of the "temporal interval" and "image forming time" to be longer than a normal speed. The term "temporal interval" means an interval between an image formation for one sheet member 111 and an image formation for next sheet member 111. Setting the temporal interval is an example of intermittent drive. Continuously changing a speed for conveying the sheet member 111 may be used as a method for lengthening the temporal interval. The term "image forming time" means a time required for forming an image on the sheet member 111. Accordingly, it is possible to reduce energy output by the mechanical drive unit 200 per unit time. In other words, by reducing a movement speed, it is possible to perform a continue print operation without an excessive power although the load torque increases.

Each of the toner cartridges 170C, 170M, 170Y, 170K has viscous load compositions such as frictional load and inertial load. Therefore, energy output by the mechanical drive unit 200 can be reduced by reducing the number of rotation of rollers such as the development roller 173K and the agitator 172K.

On the other hand, in Step S600, the printer 1 conducts normal speed setting processing. Therefore, within a range that the mechanical drive unit 200 is able to output, print processing can be performed without reduction in speed.

In Step S700, the printer 1 conducts one page printing processing in which an image for one sheet is formed on one sheet member 111. On completion of the one page printing processing, the processing proceeds to Step S800.

In Step S800, the printer 1 conducts increment processing of the number of continuous prints (CP=CP+1).

In Step S900, the printer 1 determines whether the one page printing processing is completed. More specifically, the determination is made based on whether a next page to be printed remains. If the next page to be printed remains (Step S900: No), the processing returns to Step S400. If the print data for the next page does not remain (Step S900: Yes), the printer 1 terminates the print processing.

According to the print processing method of Embodiment 1, based on the torque information including information indicating torque used for the mechanically driving of the cartridge mechanism unit, the printing speed, i.e., the speed at which the printing medium moves per unit time is reduced (restricted), and an appropriate driving control can be performed according to load of the cartridge mechanism unit. Consequently, it possible to restrict the load of the driving unit within an appropriate range.

Accordingly, since the torque according to the load of the cartridge mechanism unit can be output while the load of the driving unit is kept in the appropriate range, the use of a cartridge having the cartridge mechanism unit greater in torque load can be realized, without changing the specification of the driving unit. In other words, it is also possible to provide the degree of freedom in design to the specification of the driving unit. As used herein, the "appropriate range" means a range of various aspects, such as output (or temperature) of the driving unit (e.g., a motor or a driving circuit) and an internal temperature of the image forming apparatus, for maintaining a state enabling good image forming operation.

In the print processing method of Embodiment 1, the number of continuous printing sheets is determined (changed) according to the remaining toner amount accommodated in the toner cartridge. Therefore, unlike the technique described in the background in which the torque information is constantly subjected to certain driving control, even when the load torque of the cartridge is changed depending on the remaining toner amount, printing can be conducted by adjusting so that the internal environments of the image forming apparatus can be kept in an appropriate range.

C-1. Modification 1 of Embodiment 1

In the above-described Embodiment 1, it is assumed that a single print job is input. However, the input of a plurality of print jobs can also be processed similarly. In this way, every time each of the plurality of print jobs is input, the count of print processing media is cleared. Therefore, for example, when the driving circuit 210 having small heat capacity (for example, an integrated circuit) to such an extent that no consideration is needed for heat accumulation among the plurality of print jobs is to be set in a thermal environment, a plurality of jobs can be smoothly processed. Therefore, the control of the embodiments is easily and effectively applicable.

On the other hand, when the driving motor 220 having a large heat capacity (for example, an integrated circuit) is to be set in a thermal environment and a plurality of print jobs are input, every time each of the plurality of print jobs is input, print processing is stopped only for cooling time period which is set in advance, and the count is cleared.

More specifically, when continuously processed print jobs are input, after one print job is input (S100), cooling processing is inserted. The cooling processing is processing such that the mechanical drive unit 200 is stopped only for a predetermined time period, which is set in advance, to cool the mechanical drive unit 200. In this way, it is possible to suppress heat accumulation among the plurality of print jobs, and an excessive temperature rise can be suppressed only by controlling the number of continuous inputs in each of the print jobs.

C-2. Modification 2 of Embodiment 1

When a plurality of print jobs are input, count processing of the number of continuous prints may be continued among continuously processed print jobs of the plurality of print jobs. More specifically, when the continuously processed print jobs are input, the initialization of a value of the number of continuous prints CP (Step S300) may be skipped.

In this way, the count of print processing media is continued among the continuously processed print jobs of the plurality of print jobs. Consequently, it is possible to control a driving unit, with consideration given to heat accumulated among the plurality of print jobs. The modification 2 is effectively applicable even to a case in which a constituent having a problem of excessive temperature rise is an element great in heat capacity and difficult in cooling (for example, the driving motor 220).

D. Print Processing in Embodiment 2 of the Present Invention

Figure 6:
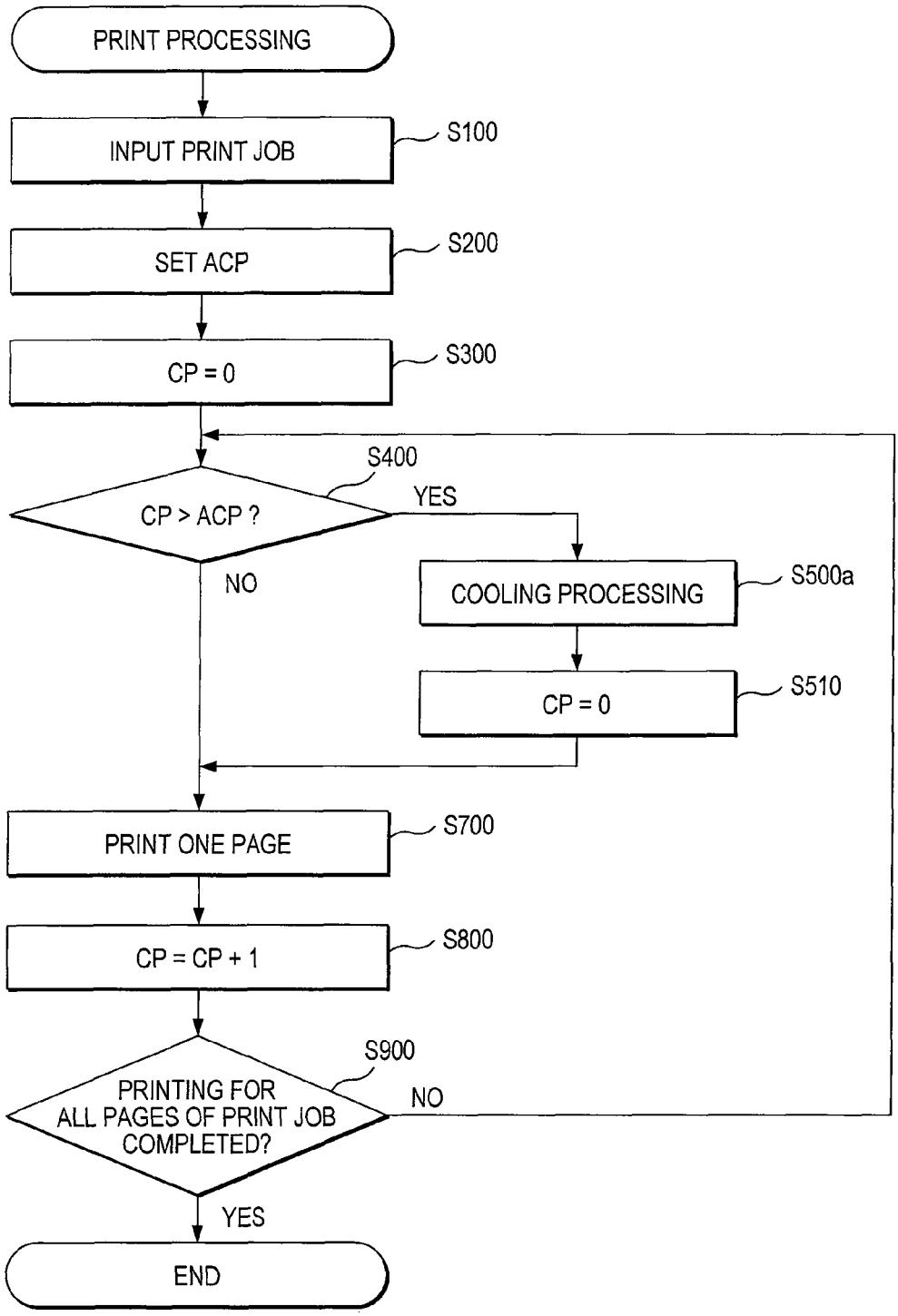
FIG. 6 is a flowchart showing routines of print processing in Embodiment 2 of the present invention.

As shown in FIG. 6, a flowchart of Embodiment 2 is different from the flowchart of Embodiment 1 in that low-speed setting processing (Step S500) is replaced by cooling processing (Step S500*a*) and also processing for initializing a value of the number of continuous prints CP (Step S510) is added. Further, the normal speed setting processing (Step S600) is deleted due to the replacement by the low-speed setting processing (Step S500).

The cooling processing is processing in which the mechanical drive unit 200 is stopped only for a predetermined time period set in advance so as to cool the mechanical drive unit 200. Thereby, the printer 1 is again able to continuously print the number of sheets (for example, 50 sheets) which is set as the number of allowable continuous prints ACP. Thus, on completion of the cooling processing, a value of the number of continuous prints CP is initialized (Step S510) and the processing proceeds to Step S700.

As described above, in the print processing method of Embodiment 2, print processing is stopped only for the cooling time period set in advance when the number of continuous prints exceeds the number of allowable continuous prints. Therefore, the number of sheets printed by the image forming unit per unit time can be reduced. Therefore, it is possible to suppress heat accumulation among the plurality of print jobs, and an excessive temperature rise can be suppressed only by controlling the number of continuous outputs in each of the print jobs.

The cooling processing may be performed once per print job. For example, the cooling process may be performed after the determination "YES" of the step S900, in other words, the cooling processing may be performed every time each of the plurality of print jobs terminates. Accordingly, even if the plurality of print jobs is input, the number of sheets printed by the image forming unit per unit time can be reduced. Therefore, it is possible to suppress heat accumulation among the plurality of print jobs, and an excessive temperature rise can be suppressed only by controlling the number of continuous outputs in each of the print jobs.

E. Modified Embodiments

As described above, several embodiments of the present invention are described. However, the present invention is not limited thereto and various changes and modifications may be made without departing the scope and spirit of the present invention. Specifically, elements other than those recited in independent claims in elements of the above embodiments are additive elements and may be omitted. Further, elements recited in the independent claims may be replaced with elements which are not recited in the independent claims within a scope disclosed in the present specification.

Still further, in the above embodiments, all of the above-described advantages and effects do not necessarily lead to essential elements of the present invention. The present invention provides the degree of freedom in design for realizing the advantages and effects easily and may be acceptable as long as it is to realize at least any one of the advantages and effects.

E-1. Modified Embodiment 1

In the above-described embodiments, the number of allowable continuous prints ACP is determined directly from the remaining toner amount. However, for example, the remaining toner amount may be referenced to estimate an internal temperature of an image forming apparatus (for example, temperature of the mechanical drive unit 200), and the number of allowable continuous prints ACP may be determined based on the estimated internal temperature.

More specifically, data showing a relationship between the remaining toner amount and load torque (graph G1 in FIG. 4A), data showing a relationship between the load torque and temperature rise of the mechanical drive unit (graph G2 in FIG. 4B) and data showing a relationship between the temperature rise of the mechanical drive unit and the number of continuous typed sheets are stored in advance in the nonvolatile memory 175K (FIG. 3). In this way, an image forming apparatus can estimate an internal temperature from the remaining toner amount based on these data and determine the number of allowable continuous prints based on the estimated internal temperature.

Accordingly, even where the number of allowable continuous prints ACP cannot be determined directly from the remaining toner amount, it is possible to determine the number of allowable continuous prints in accordance with an internal temperature estimated according to the torque information. Therefore, it is possible to suppress an excessive temperature rise due to heat in association with energy generated by the driving unit per unit time without measuring the temperature. However, for example, when the temperature sensor 230 (FIG. 3) is used to actually measure a temperature of the mechanical drive unit 200, the number of allowable continuous prints can be determined according to the actually measured internal temperature. Therefore, it is possible to suppress an excessive temperature rise reliably.

E-2. Modified Example 2

In the above-described embodiments, there is provided an example that an electronic circuit and a control board are used in a control circuit. However, the control systems can be mounted by an electronic circuit, a computer (CPU, memory and software) or in combination thereof. A program for executing print processing may be stored in advance in a memory of an image forming apparatus, and preferably, is stored in a nonvolatile memory of a toner cartridge or can be downloaded via Internet. In this way, the program can be installed in an image forming apparatus.

E-3. Modified Example 3

In the above-described embodiments, there is provided an example that an image forming apparatus includes a plurality of toner cartridges. The present invention is also applicable to an image forming apparatus including a single toner cartridge.

E-4. Modified Example 4

In the above-described embodiments, the driving motor 220 supplies power to the photoconductor body 121K of the image forming unit 120K and a mechanical unit of the toner cartridge 170K. On the other hand, the driving roller 131 (FIG. 1), the pickup roller 113 (FIG. 1) and the fixing unit 140 are mechanically driven by other mechanical drive units (not illustrated).

However, the present invention is not limited to the above-described example, and may be applicable to an image forming apparatus in which all these mechanical units can be mechanically controlled by only one motor, for example. In this image forming apparatus, the torque information stored on the nonvolatile memory 175K may include, for example, torque information for driving at least one of the driving roller 131, the pickup roller 113 and the fixing unit 140, in addition to the torque information for driving mechanical units of toner cartridges.

What is claimed is:

1. An image forming apparatus comprising:

a cartridge attachment portion to which a toner cartridge configured to accommodate toner is removably attached, the toner cartridge comprising a cartridge mechanism unit which is mechanically driven and a storage medium for storing torque information including information indicating torque used for mechanically driving the cartridge mechanism unit;

an image forming unit configured to print an image on a surface of a printing medium using toner accommodated in the toner cartridge;

a reading unit configured to read the torque information from the toner cartridge attached to the cartridge attachment portion; and a control unit configured to determine a number of printing media to be printed by the image forming unit per unit time, according to the torque information read by the reading unit, count a number of printing media which have been continuously output and decrease the number of printing media per unit time when a counted number of continuous outputs exceeds a number of allowable continuous prints which is set as a number of allowable continuous outputs.

2. The image forming apparatus according to claim 1, wherein the image forming unit is configured to continuously print images on a plurality of printing media, wherein the control unit changes a time period from a start of printing of one printing medium to a start of printing for a next printing medium according to the torque information read by the reading unit, so as to change the number of printing media per unit time.

3. The image forming apparatus according to claim 1, wherein the image forming unit is configured to continuously print images on a plurality of printing media, wherein the control unit changes time period for printing the image on each of the plurality of printing media according to the torque information read by the reading unit, so as to change the number of printing media per unit time.

4. The image forming apparatus according to claim 1, wherein the control unit is configured to change a printing speed which is a moving speed of the printing medium printed by the image forming unit, wherein the image forming apparatus has a normal printing mode in which a printing is performed at a first printing speed and a low speed printing mode in which the printing is performed at a second printing speed lower than the first printing speed, and wherein the control unit switches the normal printing mode to the low speed printing mode when the counted number of continuous outputs exceeds the number of allowable continuous prints during the normal printing mode.

5. The image forming apparatus according to claim 1, wherein, when a plurality of print jobs is input, the control unit continues to count the number of printing media processed by one or more print jobs, which are continuously processed, of the plurality of print jobs.

6. The image forming apparatus according to claim 1, wherein, when a plurality of print jobs is input, the control unit stops print processing only for a cooling time period and clears the counted number of continuous outputs every time each of the plurality of print jobs is processed.

7. The image forming apparatus according to claim 1, wherein, when a plurality of print jobs is input, the control unit clears the counted number of the continuous outputs every time each of the plurality of print jobs is processed.

8. The image forming apparatus according to claim 1, further comprising an estimation unit configured to estimate an internal temperature of the image forming apparatus at a time of forming the images according to the torque information, wherein the number of allowable continuous prints is determined according to the internal temperature estimated by the estimation unit.

9. The image forming apparatus according to claim 1, further comprising a measurement unit configured to measure the internal temperature of the image forming apparatus, wherein the number of allowable continuous prints is determined according to the internal temperature measured by the measurement unit.

10. The image forming apparatus according to claim 1, further comprising a determination unit configured to determine an amount of toner remaining in the toner cartridge, wherein the number of allowable continuous prints is determined according to the amount of remaining toner determined by the determination unit.

11. The image forming apparatus according to claim 10, wherein the number of allowable continuous prints is determined every time a print job is started.

12. A toner cartridge configured to supply toner to an image forming apparatus, said image forming apparatus including a cartridge attachment portion to which said toner cartridge is removably attached; an image forming unit configured to print an image on a surface of a printing medium using the toner; a reading unit configured to read torque information from said toner cartridge attached to said cartridge attachment portion; and a control unit configured to determine a number of printing media to be printed by said image forming unit per unit time according to the torque information read by said reading unit, said toner cartridge comprising:

a cartridge mechanism unit mechanically driven when said toner cartridge is attached to said cartridge attachment portion;

a storage medium configured to store the torque information including information indicating torque used for mechanically driving the cartridge mechanism unit; and an interface circuit configured to output the torque information to said reading unit of said image forming apparatus.

13. A non-transitory computer-readable medium having a computer program stored thereon and readable by a computer, said computer program for enabling a mechanical drive control of an image forming apparatus, said image forming apparatus comprising: a cartridge attachment portion to which a toner cartridge configured to accommodate toner is removably attached, the toner cartridge comprising a cartridge mechanism unit which is mechanically driven and a storage medium for storing torque information including information indicating torque used for a mechanical drive of the cartridge mechanism unit; an image forming unit configured to print an image on a surface of a printing medium using toner accommodated in the toner cartridge; a reading unit configured to read the torque information from the toner cartridge attached to the cartridge attachment portion; and a control unit, said computer program, when executed by the image forming apparatus, to cause the control unit of the image forming apparatus to perform operations comprising:

reading the torque information from the toner cartridge attached to the cartridge attachment portion; and determining a number of printing media to be printed by the image forming unit per unit time, according to the torque information read from the toner cartridge.

14. An image forming apparatus comprising:

a printing device configured to print an image on a sheet using toner;

a toner cartridge configured to supply toner to the printing device, the toner cartridge comprising:

a storage medium configured to store a table comprising one or more sets of associated information, each of the sets of associated information comprising a remaining toner amount and an allowable number of sheets to be continuously printed by the printing device; and a toner accommodation portion configured to accommodate the toner, a reading device configured to read the association information from the storage medium;

a toner sensor configured to detect an amount of toner remaining in the toner accommodation portion; and a control unit connected to the toner sensor and the printing device, wherein the control unit is operable to:

control the toner sensor so as to detect the amount of toner;

control the reading device so as to read the allowable number of sheets associated with the remaining toner amount corresponding to the amount of toner detected by the toner sensor, from the table stored in the storage medium; and change a number of sheets to be printed by the printing device per unit time if a number of sheets which the printing device has been printed reaches the allowable number of sheets read by the reading device.

15. The image forming apparatus according to claim 14, wherein the control unit decreases the number of sheets to be printed by the printing device per unit time if the number of sheets which the printing device has been printed reaches the allowable number of sheets read by the reading device.

16. The image forming apparatus according to claim 14, wherein, when a number of sheets to be printed is larger than the allowable number of sheets read by the reading device, the control unit suspends a printing process when the number of sheets which the printing device has printed reaches the allowable number of sheets, and after a predetermined time period, starts a printing process for a rest of the sheets to be printed.

17. An image forming apparatus comprising:

a cartridge attachment portion to which a toner cartridge configured to accommodate toner is removably attachable, the toner cartridge comprising a cartridge mechanism unit which is mechanically driven and an indicator indicating torque required for driving the cartridge mechanism unit;

an image forming unit configured to print an image on a surface of a printing medium using toner accommodated in the toner cartridge;

a reading unit configured to read torque information from the indicator on the toner cartridge; and a control unit configured to determine a number of printing media to be printed by the image forming unit per unit time, according to the torque information read by the reading unit, count a number of the printing media which have been continuously output and decrease the number of printing media per unit time when the counted number of continuous outputs exceeds a number of allowable continuous prints which is set as a number of allowable continuous outputs.

* * * * *